US008312750B2

(12) United States Patent
Koerner et al.

(10) Patent No.: US 8,312,750 B2
(45) Date of Patent: Nov. 20, 2012

(54) METHOD FOR THE PRODUCTION OF A ROTATIONALLY SYMMETRICAL PART, AND PART PRODUCED ACCORDING TO SAID METHOD

(75) Inventors: Thomas Koerner, Schwelm (DE); Ernst-Peter Schmitz, Abtsgmuend (DE); Peter Kolbe, Aalen (DE)

(73) Assignee: Gesenkschmiede Schneider GmbH, Aalen (DE)

( * ) Notice: Subject to any disclaimer, the term of this patent is extended or adjusted under 35 U.S.C. 154(b) by 989 days.

(21) Appl. No.: 12/307,865

(22) PCT Filed: Jul. 5, 2007

(86) PCT No.: PCT/DE2007/001189

§ 371 (c)(1),
(2), (4) Date: Jan. 7, 2009

(87) PCT Pub. No.: WO2008/003305

PCT Pub. Date: Jan. 10, 2008

(65) Prior Publication Data

US 2009/0312110 A1 Dec. 17, 2009

(30) Foreign Application Priority Data

Jul. 7, 2006 (DE) ..... 10 2006 031 564

(51) Int. Cl.
*B21D 17/04* (2006.01)
*B21D 17/08* (2006.01)

(52) U.S. Cl. ..... 72/88; 72/208; 138/177

(58) Field of Classification Search ..... None
See application file for complete search history.

(56) References Cited

U.S. PATENT DOCUMENTS 1,662,506 A * 3/1928 Mansfield ..... 228/131
(Continued)

FOREIGN PATENT DOCUMENTS

DE 809 303 5/1951
(Continued)

OTHER PUBLICATIONS

Bernhard Lüdenbach, Querwalzen-Maschinen-Konzepte Und Anwendungen, Umformtechnik, Meisenbach, Bamberg, DE, vol. 30, No. 3, Sep. 1996, pp. 164-167, XP000631065; ISSN: 0300-3167, The Whole Document.

(Continued)

*Primary Examiner* — Kiley Stoner
(74) *Attorney, Agent, or Firm* — Roberts Mlotkowski Safran & Cole, P.C.; David S. Safran

(57) ABSTRACT

A method for producing a rotationally symmetrical hollow metal part, particularly a shaft. According to the method, bar-shaped ductile solid material is provided, the solid material is heated from about 300° C. below the forging temperature to the forging temperature, the solid material is transversally spline-rolled until weakenings are created in the core zone (3) of the solid material and the sold material is torn open. Two mandrels (5,6) are forcibly introduced into the center of the bar-shaped solid material during the rolling process, and then one mandrel is retracted while the other mandrel continues advancing so as to produce a tubular part. A transversally spline-rolled rotationally symmetrical hollow part, especially a shaft, which is produced according to noted method can be embodied as a transmission shaft, camshaft, drive shaft, output shaft, starter shaft, hollow shaft, or can be a preform for molded parts and the like.

16 Claims, 2 Drawing Sheets

U.S. PATENT DOCUMENTS

| | | | | |
|---|---|---|---|---|
| 1,712,972 | A * | 5/1929 | Stiefel | 72/368 |
| 1,857,620 | A * | 5/1932 | Brown | 228/131 |
| 2,830,921 | A * | 4/1958 | Creutz | 148/560 |
| 3,512,403 | A * | 5/1970 | Kato | 73/87 |
| 3,818,733 | A * | 6/1974 | Cauley et al. | 72/41 |
| 4,006,618 | A * | 2/1977 | Yanagimoto et al. | 72/11.3 |
| 4,190,887 | A * | 2/1980 | Yoshiwara et al. | 700/151 |
| 4,409,810 | A * | 10/1983 | Yamada | 72/68 |
| 4,416,134 | A * | 11/1983 | Hayashi | 72/68 |
| 4,470,282 | A * | 9/1984 | Hayashi | 72/97 |
| 4,577,481 | A * | 3/1986 | Staat | 72/68 |
| 4,722,211 | A | 2/1988 | Tsukamoto et al. | |
| 8,141,405 | B2 * | 3/2012 | Hayashi | 72/283 |
| 2005/0266927 | A1 * | 12/2005 | Kuroda et al. | 464/183 |
| 2007/0175547 | A1 * | 8/2007 | Igarashi et al. | 148/442 |
| 2009/0023506 | A1 * | 1/2009 | Kondo et al. | 464/183 |
| 2009/0032151 | A1 * | 2/2009 | Oishi et al. | 148/667 |
| 2010/0132425 | A1 * | 6/2010 | Sasaki | 72/208 |

FOREIGN PATENT DOCUMENTS

| | | | |
|---|---|---|---|
| DE | 92 215 | A1 | 9/1972 |
| DE | 99 521 | | 8/1973 |
| DE | 42 25 365 | A1 | 2/1994 |
| DE | 196 17 593 | A1 | 1/1998 |
| DE | 199 05 038 | A1 | 8/2000 |
| DE | 103 08 849 | A1 | 9/2004 |
| EP | 1 339 511 | B1 | 11/2004 |
| JP | 57-7305 | A | 1/1982 |
| JP | 62-21437 | A | 1/1987 |
| JP | 62-21438 | A | 1/1987 |
| WO | WO 2006/003953 | A1 * | 1/2006 |

OTHER PUBLICATIONS

International Search Report, International Application No. PCT/DE2007/001189.

* cited by examiner

METHOD FOR THE PRODUCTION OF A ROTATIONALLY SYMMETRICAL PART, AND PART PRODUCED ACCORDING TO SAID METHOD

BACKGROUND OF THE INVENTION

1. Field of Invention

The invention relates to a method for producing a rotationally symmetrical hollow part, particularly a shaft or a transversally spline-rolled rotationally symmetrical hollow part.

2. Description of Related Art

The production of rotationally symmetrical hollow parts from solid material which can also serve, for example, as a preform for further forming, like stepped shafts, especially of a transmission shaft by transversal spline-rolling is increasingly executed. It is executed on plane jaw or round jaw machines. These transversally spline-rolled shafts are hardened by a rolling process performed on its periphery. By the use of solid material, a high weight is obtained, which is undesirable especially in the application of these kinds of shafts in the automotive industry. Transmission shafts are also costly when produced by round kneading machines from hollow shafts and then welded or the shafts are mechanically machined (deep-hole drilled).

Typical devices for the transversally spline-rolling of bars are known from East German Patent DD 99 521. Reference is made to this document to the full extent in order to avoid repetitions. In this patent, a heated bar is progressively machined between rollers wherein mandrels are arranged coaxially the rolling axis of the material and oppositely as a stopper part and as a support part and at least one mandrel being axially movable on the opposite side of the other. The axially arranged mandrels provide only supporting devices and optionally as processing devices for the end sectors or the bar—the production of a bore-hole or a through bore-hole or of a hollow part is not possible.

According to German Patent Application DE 10308849 A1, the forming production of rotationally symmetrical hollow parts in true form and net-shape from semi-finished products of bar-shaped solid materials is performed by pressing the hole using a pressing mandrel and a slide equipped with at least two pressing rolls, wherein the semi-finished product is purposefully heated before the forming process and after that is cooled whereby a desired temperature gradient from the core zone of the semi-finished product to its mantle surface is obtained; the forming zone of the emerging hollow body is cooled in order to increase the strength of the material with sufficient ductility and the hollow body is then exposed to a heat treatment with a controlled temperature profile in order to increase the strength and the toughness of the material—here of iron alloys—and in order to improve the endurance strength. Also costly temperature guidance is necessary for the execution of this process.

According to German Patent Application DE 19905038, a transversal rolling device equipped with a mandrel device is known, although in this document, there are no indications about the process parameters, like temperature or duration or about the material to work with the described mandrel device indicated there for the production of shafts in order to be able to produce a hollow part.

SUMMARY OF THE INVENTION

In view of the foregoing, the present invention seeks to provide a method for the production of a rotationally symmetrical hollow metal part for the easier production of light parts of solid material of high strength.

According to the present invention, the goals of the present invention are achieved by a method for the production of a rotationally symmetrical hollow metal part, especially of a shaft, by:

- providing bar-shaped ductile solid material;
- heating the solid material from about 300° C. below the forging temperature to the forging temperature;
- transversally spline-rolling of the solid material until weakenings are created in the core zone of the solid material and the solid material is torn open;
- introducing two mandrels into the center of the bar-shaped solid material during the rolling process; and
- retracting of one of the mandrels while the other madrel continues advancing so as to produce a tubular part.

A transversally spline-rolled rotational symmetrical hollow part produced according to the above method, especially a shaft produced according thereto, is characterized in that it can be embodied as a transmission shaft, camshaft, drive shaft, output shaft, starter shaft, hollow shaft and as a preform for formed parts and the like.

By the introduction of the mandrel into the weakened internal zone in which, because of oscillating rolling at an elevated temperature (in case of steel in the range between 900 and 1150° C.), the crystal lattice of the forgeable metal materials is weakened, the through-hole boring can be reached whereby a comparatively thick-walled rotationally symmetrical hollow part, like a hollow shaft, can be produced with a high level of precision. This weakening of the core zone of the bar during the transversally spline-rolling or its oscillating rolling effect is also known as the Mannesmann effect. Because of the high level of external pressure on the bar during the transversally spline-rolling process, the peripheral (mantle) layer of the bar-shaped material is hardened, whereby the parting of the walls is facilitated. By the insertion of the mandrel a high level of workpiece precision is achieved because the material is still formed by the external forming tools, while the hardening produced by the hot-rolling process produces shafts with corresponding strength. A typical number of rotations of the starting material up to the finished tube amounts to approximately 5-10 for chrome steel—by these rotations, the mandrels produce a bore-hole of sufficient depth or a through bore-hole wherein the continuation of the advancement of the mandrels is very advantageous for the production of bore-holes.

It is advantageous that the mandrels can be inserted with a relatively low pressure into the bar-shaped material; whereby a straight bore-hole is achieved with a relatively reduced effort.

The tubes produced by transversally spline-rolling according to the present invention are more thick-walled in comparison with the ones customarily obtained and show a hardening by the rolling treatment at an elevated temperature. Typical is a temperature of 900-1150° C. (in case of steel). By the thick peripheral walls of the tube, it is possible to obtain elevations and thinning in the tube walls by transversal rolling that is not possible with the usually drawn tubes which are not produced in this manner.

As a consequence, a typical temperature range for the method for steel according to this invention is a relatively low temperature between 900 and 1100° C. In this way, the hardening of the mantle is supported by the rolling process.

The at least one mandrel can be of an arbitrary shape, like a tooth shape, a hexagonal shape, a turning profile, etc. In this case, it is advantageous if, in the frontal borie section, it is preferred that rounded almost flat mandrels are used at a relatively low pressure, e.g., up to 5 tons, in order to produce a net-shape bore-hole.

As a consequence, the method is easy to be executed for a high numbers of parts, whereby the applied forming process produces an essentially net-shaped end shape and the so produced parts in general do not have to be reworked, so that Important savings of materials for the part and production costs are obtainable.

The hollow shaft reduces the weight as compared to the traditional shafts of solid material, and at the same time, their strength is maintained. By the insertion of the mandrels, the material in the core zone is displaced to the peripheral zone, so that a high level of precision is achieved because the material is pressed against external forming tools.

It is advantageous that two mandrels are inserted along the ends of the bar-shaped solid material. In this way, the travel of a mandrel is shortened and a higher cycle time is obtained. In this way, the mandrels are inserted without having direct contact one with the other. In the further run, one mandrel is driven back and the other mandrel is inserted onwards over an overlapping zone.

In an advantageous embodiment, the mandrels can be inserted at the same time. However, it is also possible to introduce the mandrels at different times.

A typical shaft according to the present invention, which can be used as a main transmission shaft and as an intermediate shaft has a diameter of approx. 30 to 200 mm, preferably of 60-150 mm. Of course, longer or shorter diameters can be produced. A typical wall thickness of shafts lays in the range between 0.5 and 200 mm bu the present invention is not limited to such dimensions at all.

The shaft preferably is made of a ductile or forgeable wrought metal alloy, such as 42CrMo4, 38MnVS6 and similar AFP steels (dispersion strengthened steels); of 16MnCrS4, 20MnCr5, 20MoCrS4 steel, of an aluminum or magnesium alloy, or of all of the usual types of steels known to the person skilled in the art.

In the following, the present invention is explained in detail on the basis of an embodiment of a hollow shaft and the enclosed figure, but it is not limited to it:

DETAILED DESCRIPTION OF THE INVENTION

Figure 1:
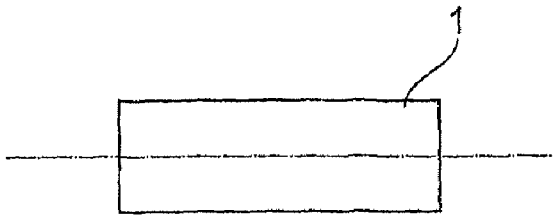
FIG. 1 shows a cross section through a preformed bar-shaped solid material.
Figure 2:
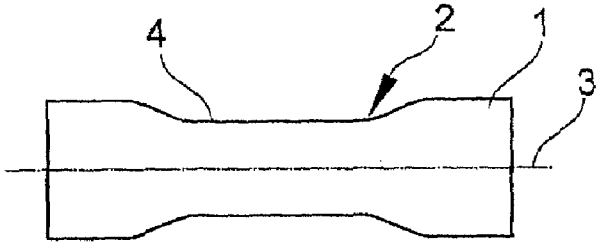
FIG. 2 shows a cross section of a transversally spline-rolled solid material during the transversally spline-rolling process.

In FIG. 1, a bar 1 of solid material is shown, which is heated to the forging temperature. In FIG. 2, it is schematically shown how the material is formed into a transversally spline-rolled shaft of different diameters. During the rolling process, the bar 1 is moved with high forces over the tools 12, 14 so that the material is hardened in the peripheral zone 4 and the core 3 becomes brittle because of the oszillating movement and is torn open. The tools 12, 14 form the peripheral part of the shaft 2 similar to its end shape. In this way collars, thinnings, etc. can be formed. A typical wall thickness of such a shaft amounts to 5-10 mm.

Figure 3:
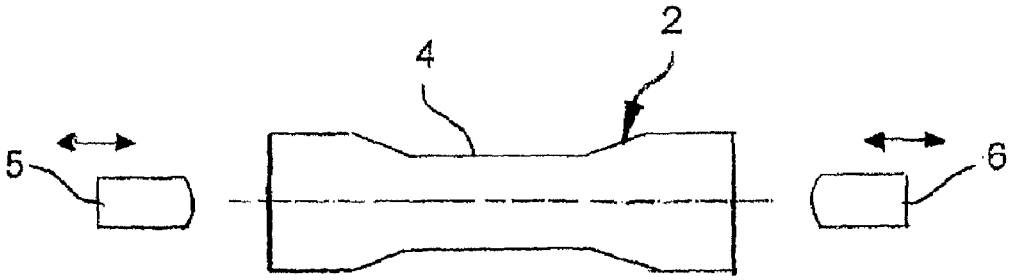
FIG. 3 shows a cross section of a shaft during the transversally spline-rolling process.

FIG. 3 shows how, from the two axial end surfaces of the shaft 2, two rotatable, moveable mandrels 5, 6 are forcibly introduced in an axial direction into the shaft 2 along the center axis 3 weakened by the Mannesmann effect. The mandrels 5, 6 continue advancing to a point before they contact. In this way, the shaft material is pressed more and more towards the external part by the moving tools 13, 14 and achieves a precise outline contour as a consequence.

Figure 4:
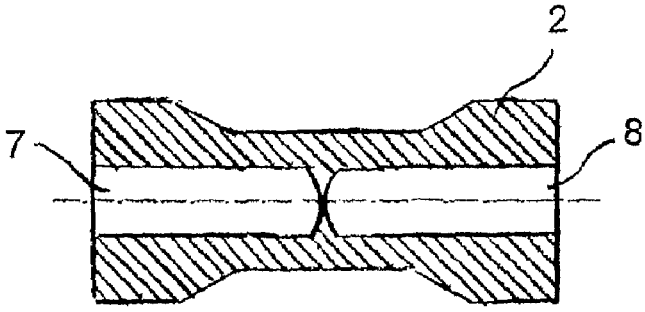
FIG. 4 shows a cross section through a shaft being equipped with two tapped blind bore-holes during the insertion of the mandrels.
Figure 5:
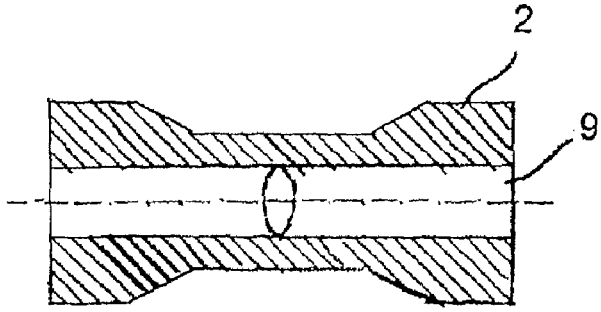
FIG. 5 shows a cross section through a shaft equipped with a through bore hole.

FIG. 4 shows a cross section through a transversally rolled shaft 2 of the first shape. On both ends, a tapped blind hole 8,8 has been produced by the mandrel.

FIG. 2 shows a cross section through a transversally rolled shaft 2 having a end shape produced by the overlapping insertion of the mandrels 5, 6. In order to produce this through bore-hole, one of the mandrels 5, 6 is retracted from an overlapping zone while the other mandrel is further inserted, overlapping a portion of the zone worked by the retracted mandrel so to produce a through hole-bore 9. In order to make the through bore hole plane smooth in a following step, the mandrel that produced the through bore hole is retracted and the first retracted mandrel is driven across the overlapping zone.

In this way, a transversally spline-rolled hollow shaft is produced whereby larger diameters, depending on the size of the machine, can be produced as well. Typical dimensions of a finished shaft are diameters between 30 and 200 mm, preferably between 60 and 150 mm. Suitable materials are ductile materials, like forgeable kneading alloys. Thereby the alloys are not limited to ironl alloys—non-ferrus alloys or alloys with a subordinate iron component, like ductile aluminum or magnesium alloys can also be used.

Figure 6:
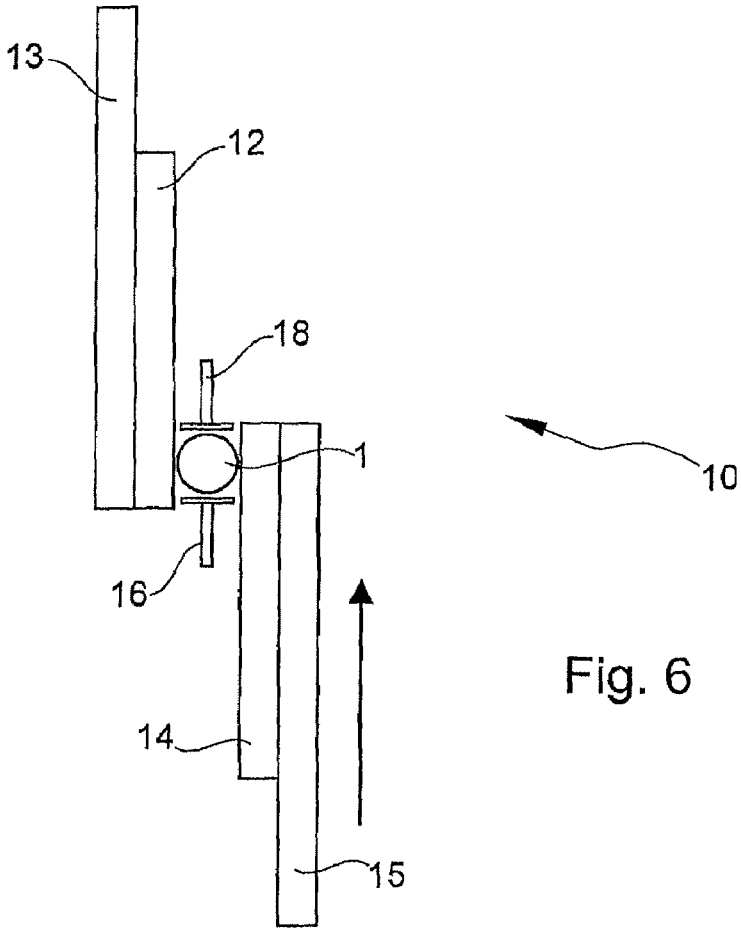
FIG. 6 is a schematic view of a cross section through a transversally spline-rolling machine.
Figure 7:
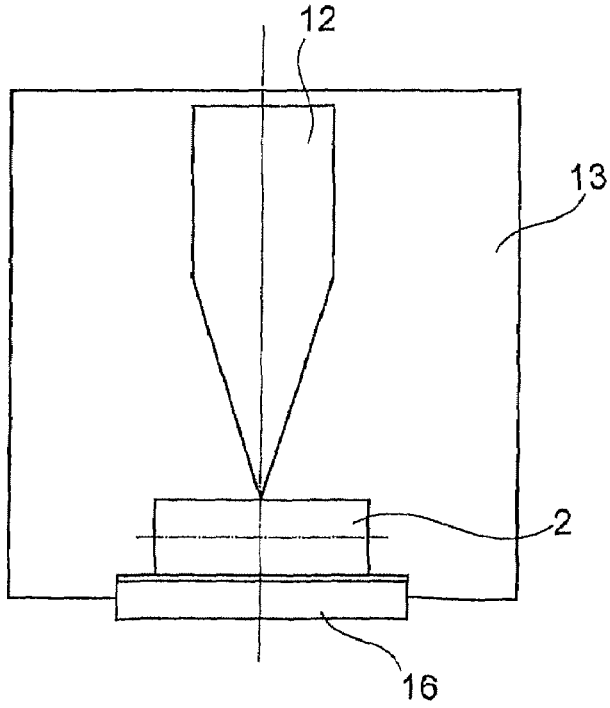
FIG. 7 schematically shows a lateral view of the transversally spline-rolling machine shown in FIG. 6.

In FIG. 6, a transversally spline-rolling machine 10 is shown in order to make the method understandable. A bar 1 is held by the material supports 16, 18 on opposite sides, like in a cage, together with two external tools 12, 14 on opposite sides. The external tools 12, 14 are arranged perpendicular to the material supports 16, 18. A tool 12 with the tool support 13 is essentially fixedly arranged while the second tool 14 moves up and down or from one side to the other in two linear directions together with the rolling bar material 1. The part is charged from both sides by the tools 12, 14 with very high forces so that is produced from the bar component 1 a transversally spline-rolled shaft 2.

By the reciprocating motion of the tool 14, the peripheral mantle 4 of the shaft hardens, while the negative relief of the tool 13, 14 is transferred to the shaft 2 as a positive shape and the core zone of the shaft is weakened.

FIG. 2 schematically shows a side view of this transversally spline-rolling machine 10 wherein one tool 12 designed as a spline exercises forces on the shaft 2 and the shaft 2 is shaped from a material support 16 and from the tool 14.

While the invention has been described in detail on the basis of a preferred embodiment, it should be apparent to the person skilled in the art that different alternatives and embodiments are possible to execute the invention within the scope of protection of the patent claims.

What is claimed is:

1. Method for the production of a rotationally symmetrical hollow metal part, comprising the steps of:

providing a bar-shaped ductile solid material;

heating the solid material to a temperature sufficient to enable forging of the solid material;

transversally spline-rolling the solid material until weakenings are created in core zone of the solid material and the solid material is torn open;

introducing two mandrels into the center of the bar-shaped solid material during the rolling process, one of the mandrels being inserted from each of opposite ends of the bar-shaped ductile solid material to a point before contacting of the mandrels would occur, in a manner hardening a peripheral mantle layer of the solid material and embrittling an inner core of the solid material while each of the the mandrels produces a bore-hole in an axially extending portion of the bar-shaped ductile solid material; and retracting a first one of the mandrels while a second one of the mandrels continues advancing to a point overlapping a portion of a zone worked by the retracted first mandrel so as to produce a tubular part with a bore hole extending completely therethrough.

2. Method according to claim 1, wherein, after the production of a bore hole, a calibration rolling of the periphery diameter is performed to obtain a circular finished external circumference.

3. Method according to claim 1, wherein the mandrels are inserted at the same time.

4. Method according to claim 2, wherein the mandrels are inserted at different times.

5. Method according to claim 1, wherein the external shape of the tubular part produced is transversally rolled to produce at least one of elevations and thinnings.

6. Transversally spline-rolled, rotationally symmetrical tubular part produced according to the method of claim 1, wherein the tubular part is one of a transmission shaft, camshaft, drive shaft, output shaft, starter shaft, hollow shaft, or a preform for the production of molded parts.

7. Transversally spline-rolled rotationally symmetrical tubular part according to claim 6, wherein the tubular part has a diameter of approximately 30 to 200 mm.

8. Transversally spline-rolled rotationally symmetrical tubular part according to claim 6, wherein the tubular part has a diameter of approximately 60 - 150 mm.

9. Transversally spline-rolled rotationally symmetrical tubular part according to claim 6, wherein the tubular part has a diameter of approximately 50 - 80 mm.

10. Transversally spline-rolled rotationally symmetrical tubular part according to claim 7, wherein the tubular part has a wall thickness of approximately 0.5-20 mm.

11. Transversally spline-rolled rotationally symmetrical tubular part according to claim 7, wherein the tubular part has a wall thickness of approximately 5-10 mm.

12. Transversally spline-rolled rotationally symmetrical tubular part, according to claim 6, wherein the hollow part is made of a ductile forgeable wrought alloy.

13. Transversally spline-rolled rotationally symmetrical tubular part according to claim 6, wherein the hollow part is made of a material selected from the group consisting of steel 42 CrMo4; 38 MnVS6, 16MnCrS4, 20MnCr5, and 20MoCrS4 steel.

14. Transversally spline-rolled rotationally symmetrical tubular part according to claim 6, wherein the hollow part is made of one of a non-ferrous alloy, aluminum alloy or magnesium alloy.

15. Method according to claim 1, wherein said solid material is a steel and the temperature to which it is heated is in a range of about 900° C. and 1150° C.

16. Method according to claim 1, comprising the further steps of holding the bar between a pair of material supports located on first opposite sides of the bar with two external tools located on second opposite sides of the bar, the external tools being arranged perpendicular to the material supports, and wherein said hardening of the peripheral mantle layer is performed by holding one of the external tools essentially fixedly arranged while producing a reciprocating motion of the other of the external tools in two linear directions

* * * * *